US007522178B2

(12) United States Patent
Shoji et al.

(10) Patent No.: US 7,522,178 B2
(45) Date of Patent: Apr. 21, 2009

(54) HEATING RESISTANCE ELEMENT, THERMAL HEAD, PRINTER, AND METHOD OF MANUFACTURING HEATING RESISTANCE ELEMENT

(75) Inventors: Noriyoshi Shoji, Chiba (JP); Yoshinori Sato, Chiba (JP); Toshimitsu Morooka, Chiba (JP)

(73) Assignee: Seiko Instruments Inc. (JP)

( * ) Notice: Subject to any disclaimer, the term of this patent is extended or adjusted under 35 U.S.C. 154(b) by 349 days.

(21) Appl. No.: 11/583,196

(22) Filed: Oct. 19, 2006

(65) Prior Publication Data

US 2007/0091161 A1 Apr. 26, 2007

(30) Foreign Application Priority Data

Oct. 25, 2005 (JP) ..... 2005-309802
Aug. 28, 2006 (JP) ..... 2006-230591

(51) Int. Cl.
*B41J 2/335* (2006.01)

(52) U.S. Cl. ..... 347/205

(58) Field of Classification Search ..... None
See application file for complete search history.

(56) References Cited

U.S. PATENT DOCUMENTS 5,357,271 A 10/1994 Wiklof et al. ..... 346/76
5,940,109 A * 8/1999 Taniguchi et al. ..... 347/205

FOREIGN PATENT DOCUMENTS

| | | |
|---|---|---|
| EP | 0763431 | 3/1997 |
| EP | 0767065 | 4/1997 |
| FR | 2702705 | 9/1994 |
| JP | 62105646 | 5/1987 |

* cited by examiner

*Primary Examiner*—K. Feggins
(74) *Attorney, Agent, or Firm*—Adams & Wilks

(57) ABSTRACT

A thermal head is structured to have a substrate, a thermal storage layer formed on one surface of the substrate and made of glass, and heating resistors provided on the thermal storage layer. A plurality of hollow portions are formed at a position spaced apart from a surface where the heating resistors are formed by laser processing using a femtosecond laser, in an area of the thermal storage layer which is opposed to the heating resistors. In this way, to provide a heating resistance element for improving heating efficiency of heating resistors to reduce power consumption, improving strength of a substrate under the heating resistors, and for enabling simple manufacture at a low cost, a thermal head and a printer using the same, and a method of manufacturing a heating resistance element.

23 Claims, 12 Drawing Sheets

HEATING RESISTANCE ELEMENT, THERMAL HEAD, PRINTER, AND METHOD OF MANUFACTURING HEATING RESISTANCE ELEMENT

BACKGROUND OF THE INVENTION

1. Field of the Invention

The present invention relates to a heating resistance element, a thermal head and a printer using the same, and a method of manufacturing a heating resistance element.

2. Related Background Art

A heating resistance element is used in, for example, a thermal head of a thermal printer. In a typical structure, a thermal storage layer made of glass or the like is provided on a substrate made of alumina ceramic or the like, and a plurality of heating resistors are provided on the thermal storage layer.

Here, a thermal printer is a generic name for a thermal transfer printer for transferring ink heated and fused by a thermal head onto an object to be printed, a direct thermal printer for directly forming an image on thermal paper by a thermal head, and the like.

In a thermal printer, by making heating resistors of a thermal head to selectively generate heat, and by applying heat to an object to be heated such as an ink ribbon or thermal paper at a desired position, ink is fused and transferred onto an object to be printed in a desired pattern, or a desired pattern is formed on thermal paper.

As equipment using such the heating resistance element, in recent years, power saving products capable of being driven by a battery and mainly used as small sized and lightweight portable equipment are widely in use. Further, recently, due to energy circumstances in view of saving the environment or the like, power saving such as no power consumption in a dormant state is actively promoted even for stationary electronic equipment using no battery. Also, it is essential to increase energy efficiency.

It is said that, with a conventional heating resistance element, most heat generated by heating resistors does not contribute to printing or the like which is a target of a heating process, and that the heat is transferred to a substrate side through a material forming the heating resistance element or a thermal storage layer.

Therefore, attempts are made to attain power saving of the heating resistance element by preventing the heat generated by the heating resistors from being transferred to the substrate as much as possible, and by making effective use of the heat for a heating process such as printing (that is, by increasing the heating efficiency).

Further, when a thermal head continuously performs print output, since heat is continuously transferred to the substrate, heat radiation from the substrate cannot keep up with the heat transfer, and the whole thermal head is brought up to a considerably high temperature. Because this temperature rise is a cause of deterioration of print quality, in order to materialize high quality continuous printing, it is necessary to increase the heating efficiency of the thermal head.

As a thermal head with an increased heating efficiency, one structured as disclosed in Japanese Patent Application Laid-open No. Hei 6-166197, for example, has been devised. This thermal head has a structure in which a plurality of heating resistors are provided with intervals therebetween on a surface of an insulating substrate composed of an insulating substrate body and an underglaze layer formed on a surface of the insulating substrate body, and in which wiring for supplying electric power to these heating resistors is provided.

Attempts are made to make the band-like hollow portion function as a heat insulating layer having low thermal conductivity, and to decrease the amount of heat transferred from the heating resistors to the insulating substrate side, and thus, to improve the heating efficiency, by providing a band-like hollow portion extending along a direction of arrangement of the heating resistors at a midpoint in a thickness direction of the underglaze layer.

The band-like hollow portion is formed in the underglaze layer by embedding a band-like cellulosic resin when the underglaze layer is being formed, and by vaporizing the cellulosic resin in a baking process.

However, the thermal head disclosed in Japanese Patent Application Laid-open No. Hei 6-166197 has the following problems.

First, although a provision of the hollow portion under the heating resistors has a thermally insulating effect in a direction of the insulating substrate body, because the hollow portion is formed at the midpoint in the thickness direction, it is necessary for the underglaze layer itself to be formed relatively thick. Therefore, the amount of heat transferred to the underglaze layer accumulates in the underglaze layer. Accordingly, since the amount of heat transferred to a surface side of the heating resistors is small, the heating efficiency is low.

Second, dimensional precision of the resin material to be vaporized for forming the hollow portion is low, so a precisely shaped hollow portion cannot be formed. Therefore, because the hollow portion is formed to be band-like across the plurality of heating resistors along the direction of arrangement of the plurality of heating resistors, the strength of the underglaze layer at the positions of the heating resistors is low, and thus, the hollow portion is liable to crush due to pressure applied to the heating resistors in printing. In particular, because a drum, which sandwiches printing paper with the heating resistors, is disposed along the direction of arrangement of the heating resistors, there is a fear that the underglaze layer cracks along the direction of arrangement of the heating resistors.

Third, in a conventional method in which the hollow portion is provided at the midpoint in the thickness direction of the underglaze layer, a vaporization component layer made of a cellulosic resin is printed on a surface of an underglaze lower layer so as to be band-like and is then dried. After that, an underglaze surface layer forming paste made of a same insulating material as that of the underglaze lower layer is formed on a surface and is then dried. Further, by baking the thus laminated insulating material at about 1300° C., the vaporization component layer is vaporized. Therefore, complicated processes are necessary for providing the hollow portion under the heating resistors, and requires much time in manufacture.

SUMMARY OF THE INVENTION

The present invention is made in view of the above-mentioned circumstances. An object of the present invention is to provide a heating resistance element for improving the heating efficiency Of the heating resistors to reduce power consumption, improving the strength of a substrate under the heating resistors, and enabling simple manufacture at a low cost, a thermal head and a printer using the heating resistance element, and a method of manufacturing a heating resistance element.

In order to solve the above-mentioned problems, the present invention adopts the following means.

According to a first aspect of the present invention, there is provided a heating resistance element, including: a substrate; a thermal storage layer made of glass and formed on a surface of the substrate; and heating resistors provided on the thermal storage layer, in which one of a plurality of hollow portions and aserpentine hollow portion is/are formed at a position spaced apart from a surface where the heating resistors are formed by laser processing using a femtosecond laser, in an area of the thermal storage layer which is opposed to the heating resistors.

In the thus structured heating resistance element, because the hollow portion is formed in the area of the thermal storage layer which is opposed to the heating resistors, the hollow portion functions as a heat insulating layer for controlling an inflow of heat from the heating resistors to the substrate.

The hollow portion is formed by performing laser processing on the thermal storage layer using a femtosecond laser.

Therefore, according to the heating resistance element of the present invention, compared with a conventional case where the heating resistance element has a hollow portion, the manufacturing process is simpler and the manufacturing cost is lower.

Further, because portions in the thermal storage layer which remain between the plurality of hollow portions or between the serpentine hollow portion function as columns for supporting upper and lower portions of the hollow portion in the thermal storage layer, the strength of the thermal storage layer is sufficiently secured even in the vicinity of the hollow portion.

Here, the laser processing using the femtosecond laser is conducted by photoionization. More specifically, because, in the laser processing using the femtosecond laser, portions to be processed are directly decomposed by a laser beam, a work is not damaged by heat or plasma unlike the ordinary laser processing.

Further, when a work is made of a material transparent to laser light, such as glass, the inside of the work can be processed by the laser processing using the femtosecond laser, without damaging a surface of the work, by condensing laser light inside the work.

Further, when glass is processed by the femtosecond laser, portions to be processed are vaporized to form a hollow portion at the portions to be processed. Here, because glass forming the portions to be processed is forced to the periphery of the portions to be processed, material density of the periphery of the portions to be processed in the work increases.

Therefore, in the heating resistance element according to the present invention, the hollow portion is formed in the thermal storage layer made of glass without damaging the surface thereof, and the density of the periphery of the hollow portion is increased in the thermal storage layer, so the strength of the thermal storage layer is sufficiently secured even in the vicinity of the hollow portion.

Further, because the femtosecond laser is laser light having an extremely short pulse width, the laser light can be condensed to about 1 μm in diameter. Because photoionization is a process which depends on the strength, in the laser processing by the femtosecond laser, a range equal to or smaller than a luminous flux diameter at a condensing point of the laser light can be processed.

Therefore, in the heating resistance element according to the present invention, the shape and position of the hollow portion in the thermal storage layer can be controlled with high precision. Thus, the hollow portion can be formed precisely at a position opposed to the heating resistors in a desired shape, and the inflow of heat from the heating resistors to the substrate can be effectively controlled.

Here, if the distance from a surface of the thermal storage layer where the heating resistors are formed to the hollow portion is smaller than 1 μm, the thickness of the thermal storage layer in an area between the hollow portion and the heating resistors is so small that it is difficult to secure the strength. Further, if the distance from the surface of the thermal storage layer where the heating resistors are formed to the hollow portion is larger than 30 μm, heat transferred from the heating resistors to the thermal storage layer propagates the periphery of the hollow portion to be transferred to the substrate. Thus, the thermal insulation performance between the heating resistors and the substrate decreases.

Therefore, it is preferable that the distance from the surface of the thermal storage layer where the heating resistors are formed to the hollow portion is set to be in a range of 1 μm or more to 30 μm or less.

Here, when the substrate is made of ceramic, because the surface of the substrate has minute irregularities formed thereon, it is difficult for the surface of the thermal storage layer to be formed on the substrate to be completely plane.

Because the thermal storage layer is made of glass and is transparent, it is difficult to grasp the shape of the surface of the thermal storage layer as it is.

Here, by providing a reflection layer at a position spaced apart from the surface of the thermal storage layer along the surface, the shape of the surface of the thermal storage layer can be predicted based on the shape of the surface of the reflection layer, and even when the surface of the thermal storage layer is not plane, the hollow portion can-be formed along the surface of the thermal storage layer.

In this way, by making constant the distance from the surface to the hollow portion for the respective portions of the thermal storage layer, the strength and the thermal insulation performance of the respective portions of the thermal storage layer can be kept constant, and the quality is made stable.

Here, the reflection layer may be formed by a metal layer, an organic layer, a colored glass layer, or the like.

For example, when the thermal storage layer is prepared by a lamination method such as CVD (chemical vapor deposition), the thermal storage layer having the reflection layer as described above can be easily prepared by forming, during a lamination process, the reflection layer on a glass layer already laminated, and by further forming a glass layer on the reflection layer.

In the heating resistance element, it is preferable that the dimension of the hollow portion in a thickness direction of the thermal storage layer is larger than the dimension of the hollow portion in a direction along the surface of the thermal storage layer.

In this case, because the cross section of the portions left between the hollow portions in the thermal storage layer along the surface of the thermal storage layer becomes smaller, heat transfer through these portions decreases, and the inflow of heat from the heating resistors to the substrate can be effectively controlled.

According to a second aspect of the present invention, there is provided a heating resistance element, including: a substrate; a thermal storage layer provided on the substrate; and heating resistors provided on the thermal storage layer, in which an area of the thermal storage layer which is opposed to the heating resistors has a hollow portion, and a specific gravity of a portion of the thermal storage layer in proximity to the hollow portion is set to be larger than that of other portions of the thermal storage layer.

In the heating resistance element, because the specific gravity of a portion of the thermal storage layer in proximity to the hollow portion is larger than that of other portions (i.e., the density is higher), the strength of the thermal storage layer is sufficiently secured even in the vicinity of the hollow portion.

According to the second aspect of the present invention, it is preferable that the portion of the thermal storage layer in proximity to the hollow portion is harder than other portions of the thermal storage layer.

In the heating resistance element, because the strength of the thermal storage layer is sufficiently secured even in the vicinity of the hollow portion, the strength of the thermal storage layer as a whole can be secured with the structure in which the thermal storage layer is provided with the hollow portion.

According to the second aspect of the present invention, it is preferable that the portion of the surface of the thermal storage layer which is opposed to the hollow portion is formed so as to be convex.

In this way, because the surface of the thermal storage layer in an area opposed to the heating resistors on the side of the heating resistors bulges than other areas, the amount of protrusion of the heating resistors from the thermal storage layer becomes larger. Therefore, when such the heating resistance element is used as a thermal head, because the pushing pressure applied by the heating resistors to an object to be printed in printing increases, the printing efficiency is improved.

According to the second aspect of the present invention, it is preferable that the hollow portion is formed by laser processing. Further, according to the second aspect of the present invention, it is more preferable that the hollow portion is formed by laser processing using a femtosecond laser.

In this way, by forming the hollow portion by laser processing, as described above, the heating resistance element can be structured to have improved density and hardness in the portion of the thermal storage layer in proximity to the hollow portion without damaging the surface of the thermal storage layer.

According to the first or second aspect of the present invention, it is preferable that the density of the hollow portion in the thermal storage layer decreases as the hollow portion approaches the surface where the heating resistors are formed.

In this case, because, in the thermal storage layer, the density of the thermal storage layer increases as the distance from the substrate for supporting the thermal storage layer increases, the strength can be secured with the structure in which the thermal storage layer has the hollow portion formed therein.

According to the second aspect of the present invention, it is preferable that the hollow portion is formed in the thermal storage layer by the laser processing using the femtosecond laser, the output of the femtosecond laser becoming lower as the distance from the surface where the heating resistors are formed decreases.

The higher the output of the femtosecond laser used for the laser processing on the thermal storage layer becomes, the larger the hollow portion formed in the thermal storage layer becomes, and the lower the output of the femtosecond laser becomes, the smaller the hollow portion becomes.

Therefore, by making lower the output of the femtosecond laser used for the laser processing on the thermal storage layer as the distance from the surface of the thermal storage layer where the heating resistors are formed decreases as described above, the hollow portion formed in the thermal storage layer becomes smaller as the hollow portion approaches the surface where the heating resistors are formed.

Because this increases the density of the thermal storage layer as the distance from the substrate for supporting the thermal storage layer increases, the strength can be secured with the structure in which the thermal storage layer has the hollow portion formed therein.

According to the first or second aspect of the present invention, it is preferable that the substrate and the thermal storage layer are bonded together by an adhesive layer provided therebetween, the adhesive layer has a concave portion or an opening formed therein in a portion opposed to an area of the thermal storage layer where the heating resistors are formed, and the thermal storage layer has the hollow portion formed therein by performing the laser processing after the thermal storage layer is bonded to the substrate.

In this case, the concave portion or the opening of the adhesive layer is positioned between the portion of the thermal storage layer opposed to the area where the heating resistors are formed and the substrate. More specifically, the concave portion or the opening of the adhesive layer is positioned on the substrate side of the area of the thermal storage layer where the laser processing is to be conducted.

Therefore, when the hollow portion is formed by the laser processing in the thermal storage layer made of glass, because glass in the periphery of the laser processing area can escape into the concave portion or the opening of the adhesive layer, the hollow portion is formed without fail and the yield is improved.

Further, according to a third aspect of the present invention, there is provided a thermal head including any one of the above-mentioned heating resistance elements according to the present invention.

Because this thermal head uses a heating resistance element with high heating efficiency and low manufacturing cost, low power consumption is materialized while the cost is low.

Further, when a high-powered femtosecond laser having an output of equal to or higher than a predetermined amount is used for the laser processing on the thermal storage layer of the heating resistance element, the hollow portion is formed in the thermal storage layer while glass on the periphery of the hollow portion is displaced. Therefore, the surface on the side of the heating resistors in the area of the thermal storage layer where the hollow portion is formed (i.e., the portion opposed to the heating resistors) bulges than other areas. This increases the amount of protrusion of the heating resistors from the thermal storage layer. With the thermal head using the heating resistance element having the amount of protrusion of the heating resistors thus increased, because the pushing pressure applied by the heating resistors to an object to be printed in printing increases, the printing efficiency is improved.

Further, according to a fourth aspect of the present invention, a printer using the above-mentioned thermal head according to the present invention is provided.

Because the printer uses a thermal head with high heating efficiency and low manufacturing cost, low power consumption is materialized while the cost is low.

Further, according to a fifth aspect of the present invention, there is provided a method of manufacturing a heating resistance element including a substrate, a thermal storage layer made of glass and formed on the substrate, and heating resistors provided on the thermal storage layer, the method including forming a hollow portion in an area of the thermal storage layer which is opposed to the heating resistors, by laser processing using a femtosecond laser.

In the method of manufacturing a heating resistance element, because the hollow portion is formed by performing laser processing on the thermal storage layer using the femtosecond laser, compared with a case of a conventional heating resistance element having a hollow portion, the manufacturing process is simpler and the manufacturing cost is lower.

In the method of manufacturing a heating resistance element, it is preferable that the hollow portion is formed such that the density of the hollow portion in the thermal storage layer decreases as the hollow portion approaches the surface where the heating resistors are formed.

In this case, because, in the thermal storage layer, the density of the thermal storage layer increases as the distance from the substrate for supporting the thermal storage layer increases, the strength can be secured with the structure in which the thermal storage layer has the hollow portion formed therein.

In the method of manufacturing a heating resistance element, it is preferable that, during the laser processing, the hollow portion is formed using the femtosecond laser having the output becoming lower as the distance from the surface of the thermal storage layer where the heating resistors are formed decreases.

The higher the output of the femtosecond laser used for the laser processing on the thermal storage layer becomes, the larger the hollow portion formed in the thermal storage layer becomes, and the lower the output of the femtosecond laser becomes, the smaller the hollow portion becomes.

Therefore, by making lower the output of the femtosecond laser used for the laser processing on the thermal storage layer as the distance from the surface of the thermal storage layer where the heating resistors are formed decreases as described above, the hollow portion formed in the thermal storage layer becomes smaller as the hollow portion approaches the surface where the heating resistors are formed.

Because this increases the density of the thermal storage layer as the distance from the substrate for supporting the thermal storage layer increases, the strength can be secured with the structure in which the thermal storage layer has the hollow portion formed therein.

According to a sixth aspect of the present invention, there is provided a method of manufacturing a heating resistance element including a substrate, a thermal storage layer formed on the substrate, and heating resistors provided on the thermal storage layer, the method including forming a hollow portion in an area of the thermal storage layer which is opposed to the heating resistors, by laser processing.

In the method of manufacturing a heating resistance element, because the hollow portion is formed by performing laser processing on the thermal storage layer, compared with a case of a conventional heating resistance element having a hollow portion, the manufacturing process is simpler and the manufacturing cost is lower.

According to the sixth aspect of the present invention, it is preferable that the laser processing be conducted such that the portion of the thermal storage layer in proximity to the hollow portion has a specific gravity larger than that of other portions of the thermal storage layer.

In this case, because the strength of the thermal storage layer can be sufficiently secured even in the vicinity of the hollow portion, the heating resistance element having the strength of the thermal storage layer as a whole secured can be manufactured with the structure in which the thermal storage layer is provided with the hollow portion.

According to the sixth aspect of the present invention, it is preferable that the laser processing be conducted such that the portion of the thermal storage layer in proximity to the hollow portion is harder than other portions of the thermal storage layer.

In this case, because the strength of the thermal storage layer is sufficiently secured even in the vicinity of the hollow portion, the heating resistance element having the strength of the thermal storage layer as a whole secured can be manufactured with he structure in which the thermal storage layer is provided with the hollow portion.

According to the sixth aspect of the present invention, it is preferable that the laser processing be conducted such that the portion of the surface of the thermal storage layer opposed to the hollow portion is formed to be convex.

By thus making the surface of the thermal storage layer, in a portion opposed to the heating resistors on the side of the heating resistors, bulge than other areas, the amount of protrusion of the heating resistors from the thermal storage layer increases. Therefore, a heating resistance element having a high pushing pressure applied by the heating resistors to an object to be printed in printing and having improved printing efficiency when used as a thermal head can be manufactured.

According to the second aspect of the present invention, it is preferable that the hollow portion is formed by laser processing. Further, according to the second aspect of the present invention, it is more preferable that the hollow portion is formed by laser processing using a femtosecond laser.

By thus forming the hollow portion by laser processing, as described above, the heating resistance element having improved density and hardness in the portion of the thermal storage layer in proximity to the hollow portion can be manufactured without damaging the surface of the thermal storage layer.

According to the fifth or sixth aspect of the present invention, it is preferable that the substrate and the thermal storage layer are bonded together by an adhesive layer provided therebetween, the adhesive layer is structured to have a concave portion or an opening formed therein in a portion of the thermal storage layer opposed to an area where the heating resistors are formed, and that the hollow portion is formed in the thermal storage layer by performing the laser processing after the substrate and the thermal storage layer are bonded together.

In this case, the concave portion or the opening of the adhesive layer is positioned between the portion of the thermal storage layer which is opposed to the area where the heating resistors are formed and the substrate. More specifically, the concave portion or the opening of the adhesive layer is positioned on the substrate side of the area of the thermal storage layer where the laser processing is to be conducted.

Therefore, when the hollow portion is formed by laser processing in the thermal storage layer made of glass, because glass in the periphery of the laser processing area can escape into the concave portion or the opening of the adhesive layer, the hollow portion is formed without fail and the yield is improved.

According to the fifth or sixth aspect of the present invention, the thermal storage layer may be structured such that a reflection layer is provided at a position spaced apart from the surface-where the heating resistors are formed along the surface thereof, and the hollow portion may be formed in an area of the thermal storage layer which is opposed to the heating resistors by the laser processing using the femtosecond laser, with the reflection layer serving as a mark for a process position.

In this case, because the hollow portion is formed by performing laser processing on the thermal storage layer using the femtosecond laser, with the reflection layer serving as a mark for a process position provided at a position spaced apart from the surface of the thermal storage layer, even when the surface of the thermal storage layer is not plane, the hollow portion can be formed along the surface of the thermal storage layer.

In the heating resistance element in which the distance from the surface to the hollow portion in the respective portions of the thermal storage layer is constant as described above, because the strength and thermal insulation performance of the respective portions of the thermal storage layer can be kept constant, the quality is made stable.

According to the heating resistance element, thermal head, and printer of the present invention, low power consumption can be materialized with a low manufacturing cost. Further, the strength of the heating resistance element can be improved.

Further, according to the method of manufacturing a heating resistance element of the present invention, a heating resistance element with low power consumption can be manufactured at a low cost.

DETAILED DESCRIPTION OF THE PREFERRED EMBODIMENTS

Embodiments of the present invention are described in the following with reference to the drawings.

First Embodiment

This embodiment shows an example where the present invention is applied to a thermal printer.

Figure 1:
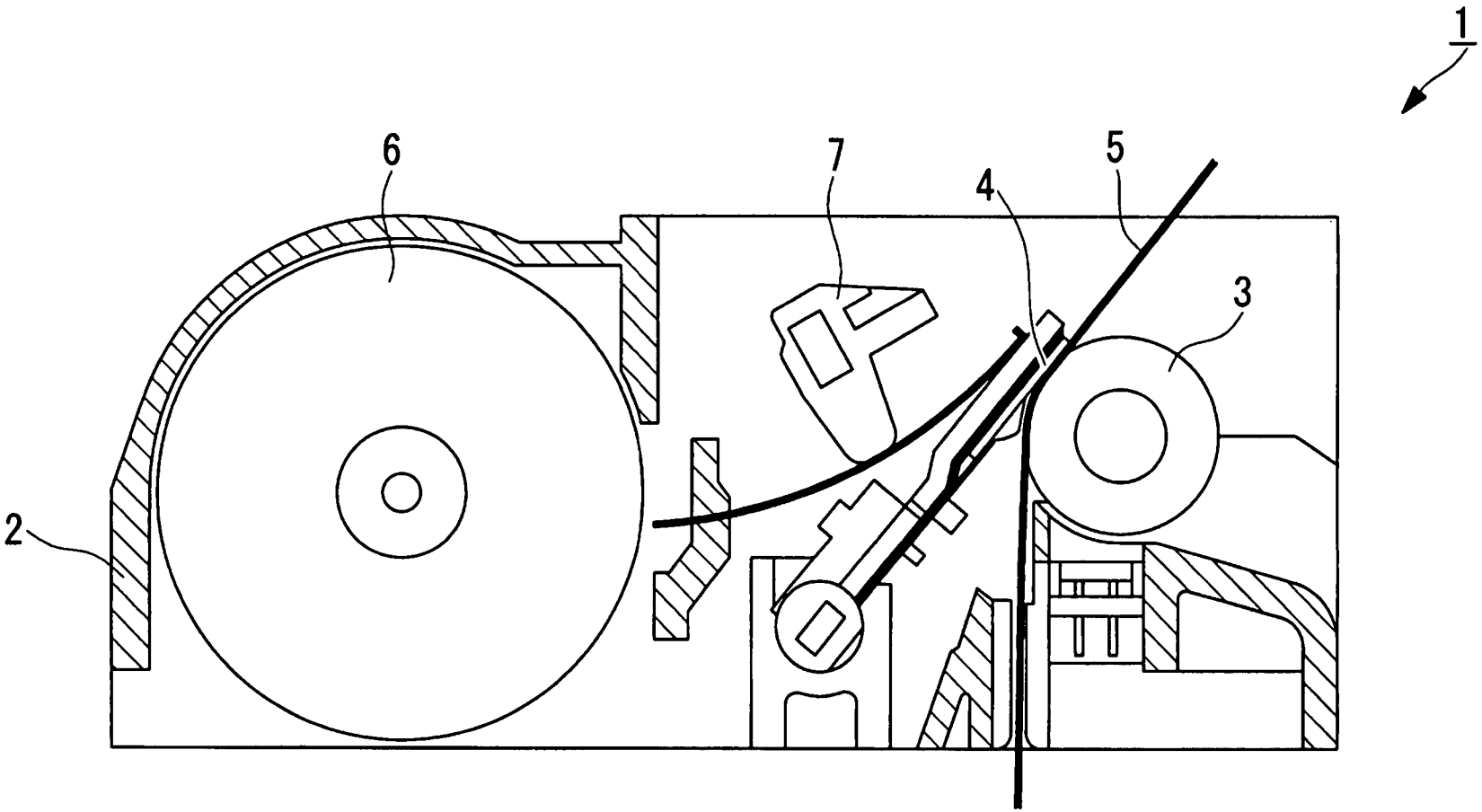
FIG. 1 is a longitudinal sectional view illustrating a structure of a thermal printer according to a first embodiment of the present invention.

As illustrated in FIG. 1, a thermal printer 1 according to this embodiment is provided with a body frame 2, a platen roller 3 horizontally disposed, a thermal head 4 (heating resistance element) disposed so as to be opposed to an outer peripheral surface of the platen roller 3, a paper feed mechanism 6 for feeding a thermal paper 5 between the platen roller 3 and the thermal head 4, and a pressure mechanism 7 for pressing the thermal head 4 against the thermal paper 5 with predetermined pressing force.

Figure 2:
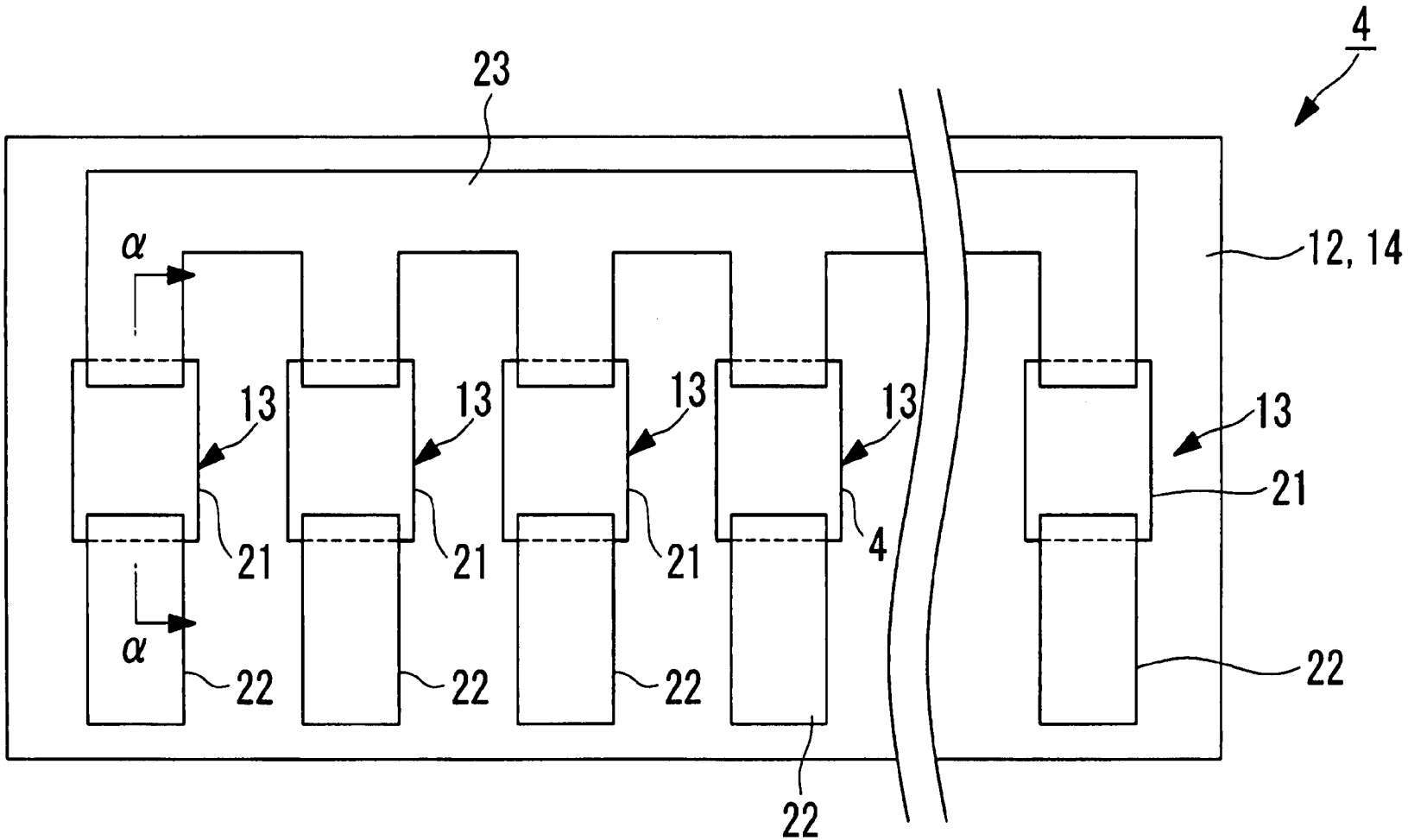
FIG. 2 is a plan view illustrating a structure of a thermal head according to the first embodiment of the present invention.
Figure 3:
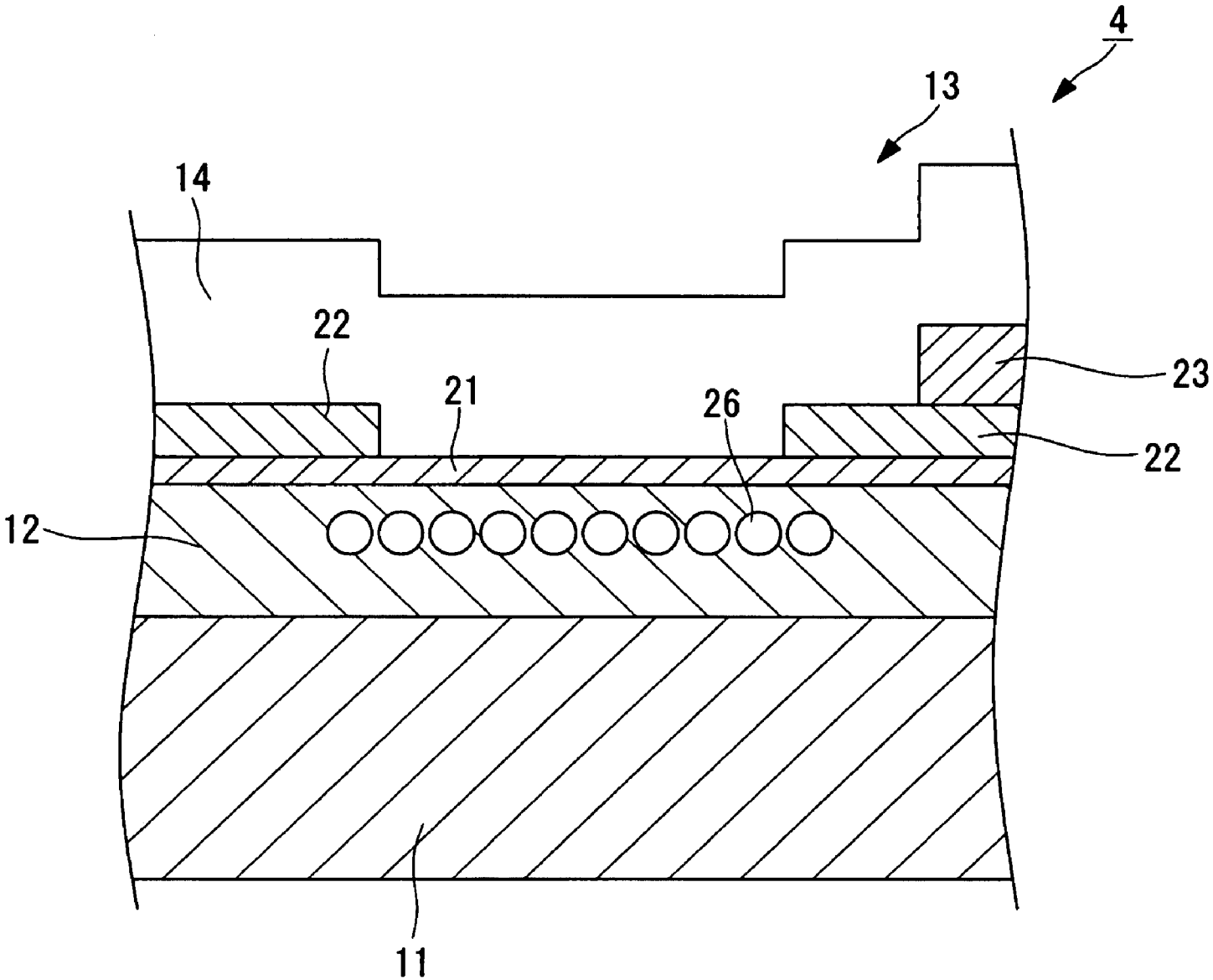
FIG. 3 is a sectional view taken along the line α-α of FIG. 2 and viewed in the direction of arrows a of FIG. 2.

The thermal head 4 is plate-like as illustrated in a plan view of FIG. 2, and as illustrated in a sectional view of FIG. 3 (a sectional view taken along the line α-α of FIG. 2 and viewed in the direction of arrows α of FIG. 2), has a substrate 11, a thermal storage layer 12 formed on one surface side of the substrate and made of, for example, glass, a heating resistor 13 provided on the thermal storage layer 12, and a protective film layer 14 for covering the thermal storage layer 12 and the heating resistor 13 to protect them against wearing and corrosion.

In this embodiment, a plurality of heating resistors 13 are arranged in the thermal head 4 along a longitudinal direction of the platen roller 3.

In the thermal head 4, similarly to a case of a typical thermal head, an insulating substrate such as a glass substrate, a silicon substrate, an alumina ceramic substrate, or the like is used as the substrate 11. As the glass substrate, one containing 50% to 80% silicon dioxide is used. Further, as the alumina ceramic substrate, one containing 95% to 99.5% aluminum oxide is used. In this embodiment, a silicon substrate is used as the substrate 11.

Here, as described below, because the thermal storage layer 12 is formed of glass, when a silicon substrate the properties of which are similar to those of the material of the thermal storage layer 12 is used as the substrate 11, distortion created when the thermal head 4 is thermally expanded is small.

Further, an alumina ceramic substrate is generally used as a substrate for a thermal head. Because the Young's modulus of the alumina ceramic substrate is larger and its mechanical strength is higher than those of a glass or silicon substrate, when a thin film-of various kinds to be the heating resistors 13 are formed as described below, distortion due to membrane stress is unlikely to occur.

The thermal storage layer 12 is, for example, a glass layer prepared by a lamination method such as CVD. In this embodiment, the thermal storage layer 12 is formed of a glass layer having a thickness of 5 μm or more, preferably from about 40 μm to about 100 μm, and has sufficient mechanical strength.

The heating resistors 13 have heating resistor layers 21 formed in a predetermined pattern on the thermal storage layer 12, and individual electrodes 22 and a common electrode 23 provided on the thermal storage layer 12 so as to contact the heating resistor layers 21.

As illustrated in FIG. 3, in the thermal storage layer 12, a plurality of hollow portions 26 are formed in an area which is opposed to the heating resistor layer 21 of the heating resistors 13 at a position spaced apart from the surface where the heating resistors 13 are formed. The hollow portions 26 function as a heat insulating layer for controlling inflow of heat from the heating resistors 13 on the thermal storage layer 12 to the substrate 11.

Here, in the thermal storage layer 12, the area where the hollow portions 26 are provided in a plan view may be smaller or larger than the area where the heating resistor layer 21 is formed insofar as its size is close to that of the heating resistor layer 21.

When the area where the hollow portions 26 are provided is larger than an effective heat generating area of the heating resistors 13, the thermal insulation performance between the heating resistors 13 and the substrate 11 increases. On the other hand, when the area where the hollow portions 26 are provided is smaller than the effective heat generating area of the heating resistors 13, the mechanical strength of the silicon substrate 11 can be improved.

Figure 4:
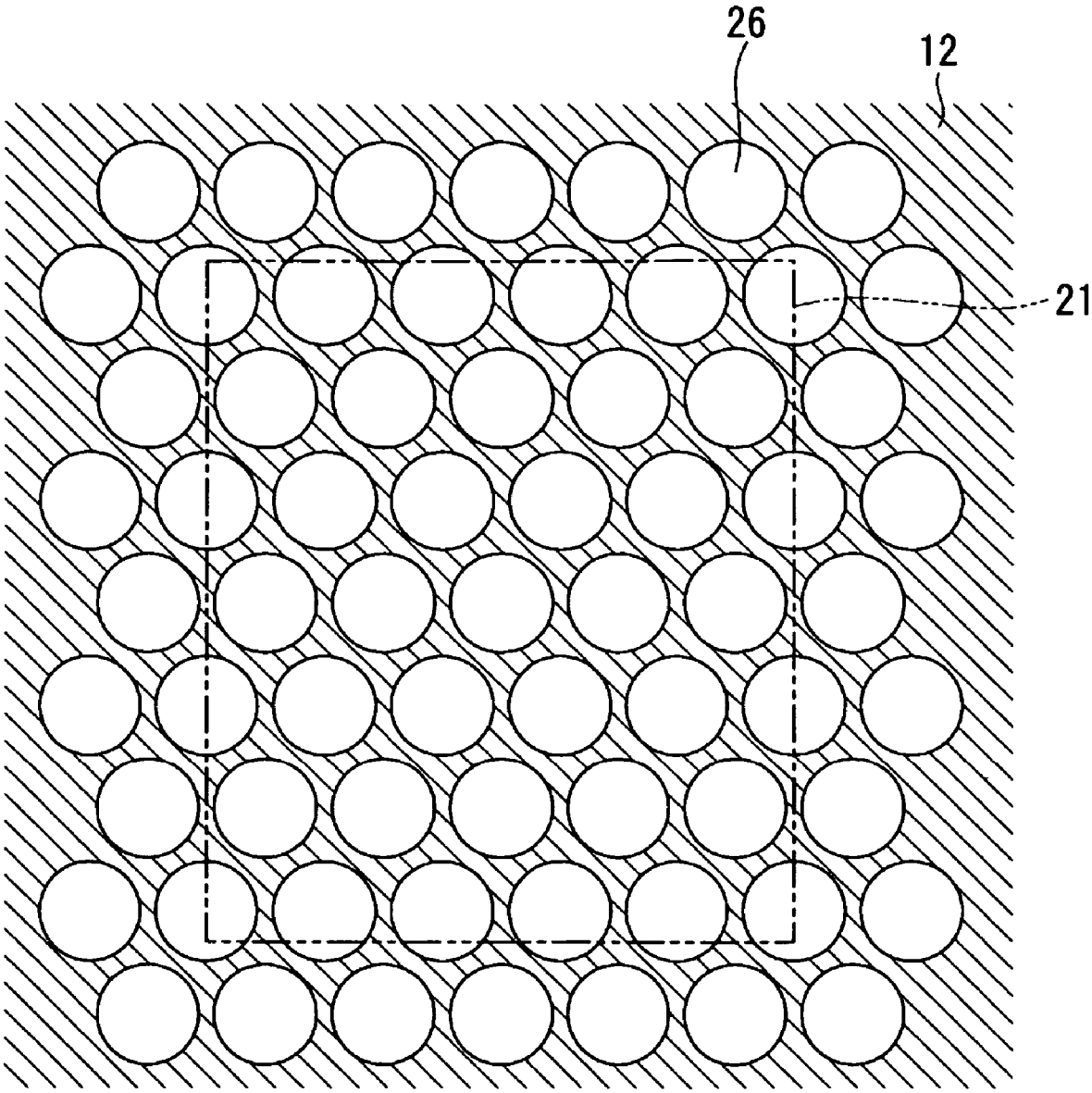
FIG. 4 is a sectional plan view illustrating the structure of the thermal head according to the first embodiment of the present invention.

In this embodiment, as illustrated in the sectional and plan views of FIGS. 3 and 4, the hollow portions 26 are provided in a range which is larger than the area of the thermal storage layer 12 where the heating resistors 13 are formed.

Further, in this embodiment, as illustrated in FIG. 4, the hollow portions 26 are staggered such that the distance between adjacent hollow portions 26 becomes as small as possible, which makes the thermal storage layer 12 have substantially uniform thermal insulation performance over the whole effective heat generating area of the heating resistors 13.

In this embodiment, the hollow portions 26 each have a ball-like shape having a diameter of about 1 μm to 10 μm. More specifically, in the thermal head 4, the height of the hollow portions 26 is sufficiently secured to be about 10 μm at the maximum, and thus, a thermally insulating effect by the hollow portions 26 is high. Further, because the height of the hollow portions 26 is 10 μm or less at the maximum, the thickness of the thermal head 4 is suppressed.

Next, a method of manufacturing the thermal head 4 according to the above embodiment is described.

First, the thermal storage layer 12 is formed on one surface of the substrate 11 (silicon wafer) by a lamination method such as CVD.

By laser processing using a femtosecond laser, the hollow portions 26 are formed in the thermal storage layer 12 formed in this way.

Here, as the femtosecond laser, an ultra-short pulse laser of ultra-high strength having a power of $1\times10^{8}$ W to $1\times10^{10}$ W and a pulse length of $1\times10^{-14}$ sec to $1\times10^{-12}$ sec is used.

Further, the laser processing can be automated by, for example, using a laser processing apparatus which automatically moves its focal point to a preset area and continuously conducts processing of a plurality of points.

After that, the heating resistor layer 21, the individual electrodes 22, the common electrode 23, and the protective film layer 14 are formed in sequence on the thermal storage layer 12. It is to be noted that the order of forming the heating resistor layer 21, the individual electrodes 22, and the common electrode 23 is arbitrary. Further, the individual electrodes 22 and the common electrode 23 may be simultaneously formed in the same process step.

The heating resistor layer 21, the individual electrodes 22, the common electrode 23, and the protective film layer 14 may be prepared using a method of manufacturing those members in a conventional thermal head.

More specifically, a thin film of, for example, a Ta-based or silicide-based heating resistor material is formed on the thermal storage layer 12 using a thin film forming method such as sputtering, CVD, or vapor deposition. By shaping the thin film of the heating resistor material using lift-off, etching, or the like, the heating resistors 13 in a desired shape is formed.

Similarly, a wiring material such as Al, Al—Si, Au, Ag, Cu, or Pt is film-formed on the thermal storage layer 12 using sputtering, vapor deposition, or the like and shaped using lift-off or etching, a wiring material is screen printed and baked thereafter, or the like process is performed, to thereby form the individual electrodes 22 and the common electrode 23 in a desired shape.

In this embodiment, by providing two separate individual electrodes 22 for one heating resistor 13 and providing the common electrode 23 so as to overlap one of the individual electrodes 22, decrease in the wiring resistance value of the common electrode 23 is intended.

After the heating resistor layer 21, the individual electrodes 22, and the common electrode 23 are formed in this way, a protective film material such as $SiO_2$, $Ta_2O_5$, SiAlON, $Si_3N_4$, or diamond-like carbon is formed on the thermal storage layer 12 by sputtering, ion plating, CVD, or the like to form-the protective film layer 14.

As a result, the thermal head 4 illustrated in FIG. 1 is manufactured.

In the thermal head 4 structured as described above, because the hollow portions 26 are formed in the area of the thermal storage layer 12 which is opposed to the heating resistors 13, the hollow portions 26 function as a heat insulating layer for controlling inflow of heat from the heating resistors 13 to the substrate 11.

Here, when the distance from the surface of the thermal storage layer 12 where the heating resistors 13 are formed to the hollow portions 26 is smaller than 1 μm, the thickness of the thermal storage layer 12 in the area between the hollow portions 26 and the heating resistors 13 is so small that it is difficult to secure the strength. Further, when the distance from the surface of the thermal storage layer 12 where the heating resistors 13 are formed to the hollow portions 26 is larger than 30 μm, heat transferred from the heating resistors 13 to the thermal storage layer 12 propagates the periphery of the hollow portions 26 to be transferred to the substrate 11, with the result that the thermal insulation performance between the heating resistors 13 and the substrate 11 decreases.

Therefore, it is preferable that the distance from the surface of the thermal storage layer 12 where the heating resistors 13 are formed to the hollow portions 26 is set to be 1 μm or more and 30 μm or less, and it is more preferable that the distance is set to be 1 μm or more and 10 μm or less.

The hollow portions 26 are formed by subjecting the thermal storage layer 12 to laser processing using a femtosecond laser.

Therefore, compared with a case of a thermal head using a conventional heating resistance element having a hollow, the thermal head 4 involves a simpler manufacturing process and lower manufacturing cost.

Further, because portions in the thermal storage layer 12 which remain between the plurality of hollow portions 26 function as columns for supporting upper and lower rims of the hollow portions 26 in the thermal storage layer 12, the strength of the thermal storage layer 12 is sufficiently secured even in proximity to the hollow portions 26.

Here, the laser processing using the femtosecond laser is conducted by photoionization. More specifically, in the laser processing using the femtosecond laser, since portions to be processed are directly decomposed by a laser beam, differently from a case of typical laser processing, a work is not damaged due to heat or plasma.

Further, when a work is made of a material transparent to laser light, such as glass, the laser processing by the femtosecond laser can process the inside of the work without damaging a surface of the work by condensing laser light into the inside of the work.

Further, when glass is processed by the femtosecond laser, portions to be processed are vaporized to form a hollow at the portions to be processed. Here, because glass forming the portions to be processed is forced to the periphery of the portions to be processed, the periphery of the portions to be processed of the work has a higher material density.

More specifically, in the thermal head 4 shown in this embodiment, the hollow portions 26 are formed in the thermal storage layer 12 made of glass without damaging the surface thereof, and the density of the periphery of the hollow portions 26 is higher in the thermal storage layer 12, and thus, the strength of the thermal storage layer 12 is sufficiently secured even in proximity to the hollow portions 26.

Further, because the femtosecond laser is laser light having an extremely short pulse width, the laser light can be condensed to about 1 μm in diameter. Because photoionization is a process which depends on the strength, in the laser processing by the femtosecond laser, a range which is smaller than a luminous flux diameter at a condensing point of the laser light can be processed.

Therefore, the thermal head 4 shown in this embodiment can control the shape and position of the hollow portions 26 in the thermal storage layer 12 with high precision, and thus, the hollow portions 26 can be formed precisely at a position which is opposed to the heating resistors 13 in a precisely desired shape, and inflow of heat from the heating resistors 13 to the substrate 11 can be effectively controlled.

As described above, in the thermal head 4 shown in this embodiment, because heat generated by the heating resistors 13 can be effectively utilized for printing, the heating efficiency of the heating resistors 13 is high.

Further, since heat generated by the heating resistors 13 in this way is unlikely to be transferred to the substrate 11, print output without a break is unlikely to cause temperature rise of the thermal head 4 as a whole. Therefore, the thermal printer 1 according to this embodiment can conduct high quality continuous printing.

As described above, the thermal head 4 involves high heating efficiency and low manufacturing cost.

Therefore, the thermal printer 1 using the thermal head 4 involves low cost while realizing low power consumption.

Figure 5:
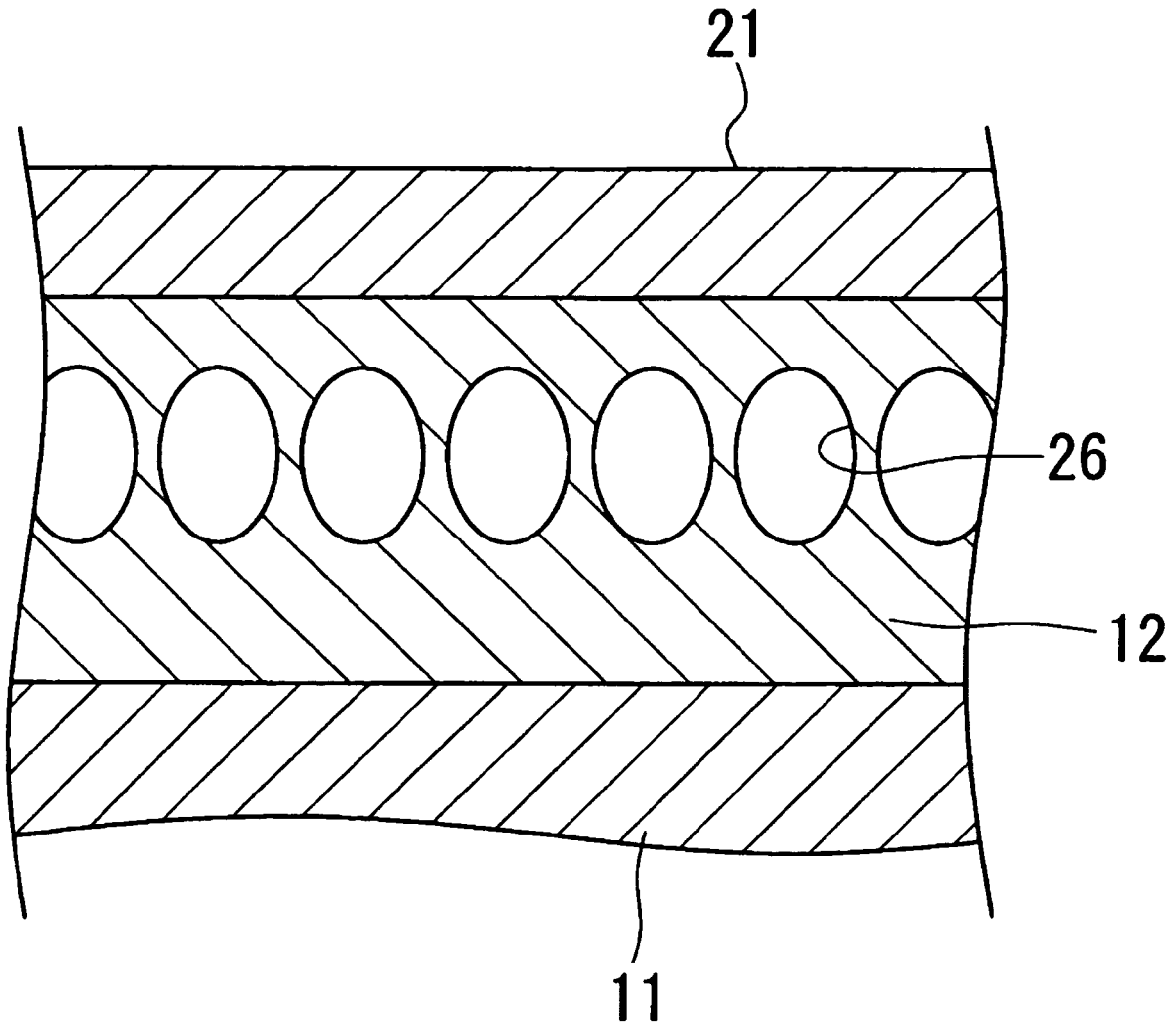
FIG. 5 is a longitudinal sectional view illustrating another example of the thermal head according to the first embodiment of the present invention.

Here, this embodiment has described the example where the hollow portions 26 each have a ball-like shape, but is not limited thereto. As illustrated in FIG. 5, the dimension of the hollow portions 26 in a thickness direction of the thermal storage layer 12 may be larger than the dimension of the hollow portions 26 in a direction along the surface of the thermal storage layer 12.

In this case, because the hollow portions 26 can be more densely disposed and the cross section of the portions left between the hollow portions 26 in the thermal storage layer 12 along the surface of the thermal storage layer 12 becomes smaller, heat transfer through those portions decreases, and inflow of heat from the heating resistors to the substrate can be effectively controlled.

Further, the shape in cross section of the hollow portions 26 in the direction along the surface of the thermal storage layer 12 is arbitrary. For example, the shape in cross section of the hollow portions 26 may be substantially hexagonal. By disposing the hollow portions 26 so as to be honeycomb in a plan view, the hollow portions 26 may be more densely disposed.

Figure 6:
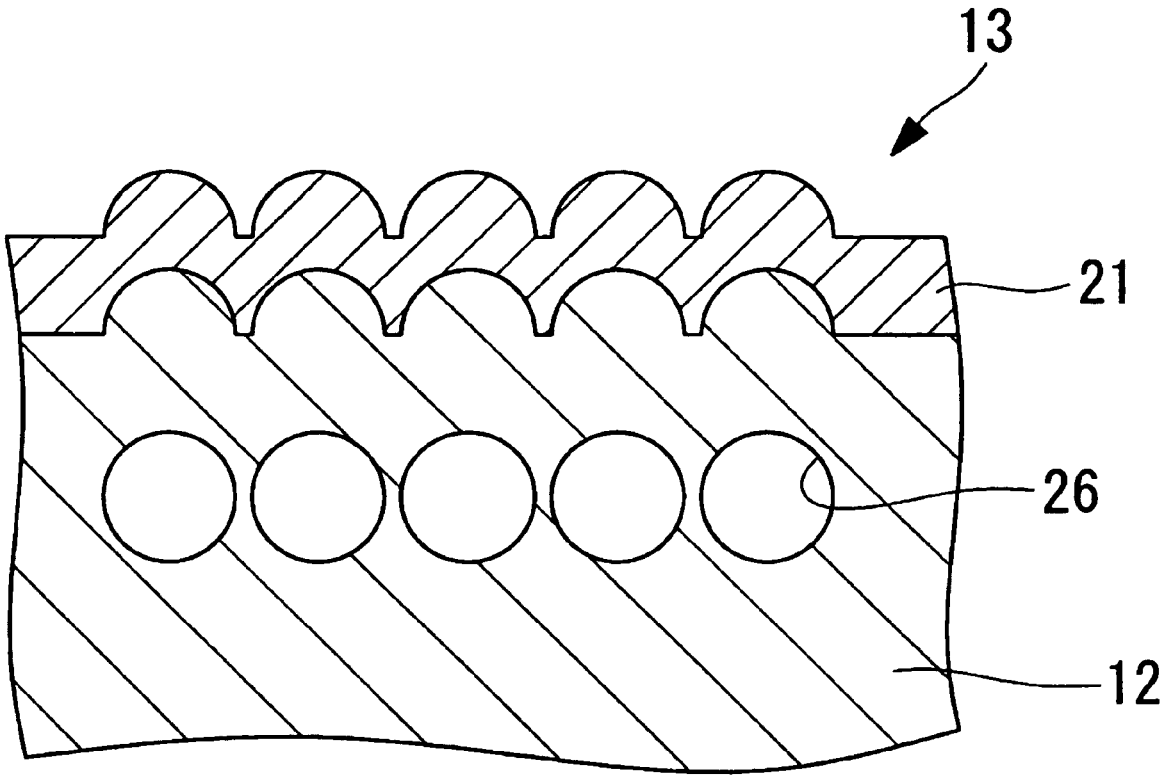
FIG. 6 is a longitudinal sectional view illustrating still another example of the thermal head according to the first embodiment of the present invention.

Here, when a high-powered femtosecond laser the power of which is equal to or higher than a predetermined amount is used for the laser processing of the thermal storage layer 12 of the thermal head 4, the hollow portions 26 are formed in the thermal storage layer 12 while glass on the periphery of the hollow portions 26 is displaced. Therefore, as illustrated in FIG. 6, the surface of the area, on the side of the heating resistors 13, of the thermal storage layer 12 where the hollow portions 26 are formed (i.e., the area which is opposed to the heating resistors 13) bulges than other areas. This makes larger the amount of protrusion of the heating resistors 13 from the thermal storage layer 12. In this way, with the thermal head 4 with the amount of protrusion of the heating resistors 13 increased, the pushing pressure applied by the heating resistors 13 to an object to be printed in printing increases, with the result that the printing efficiency is improved.

Second Embodiment

Figure 7:
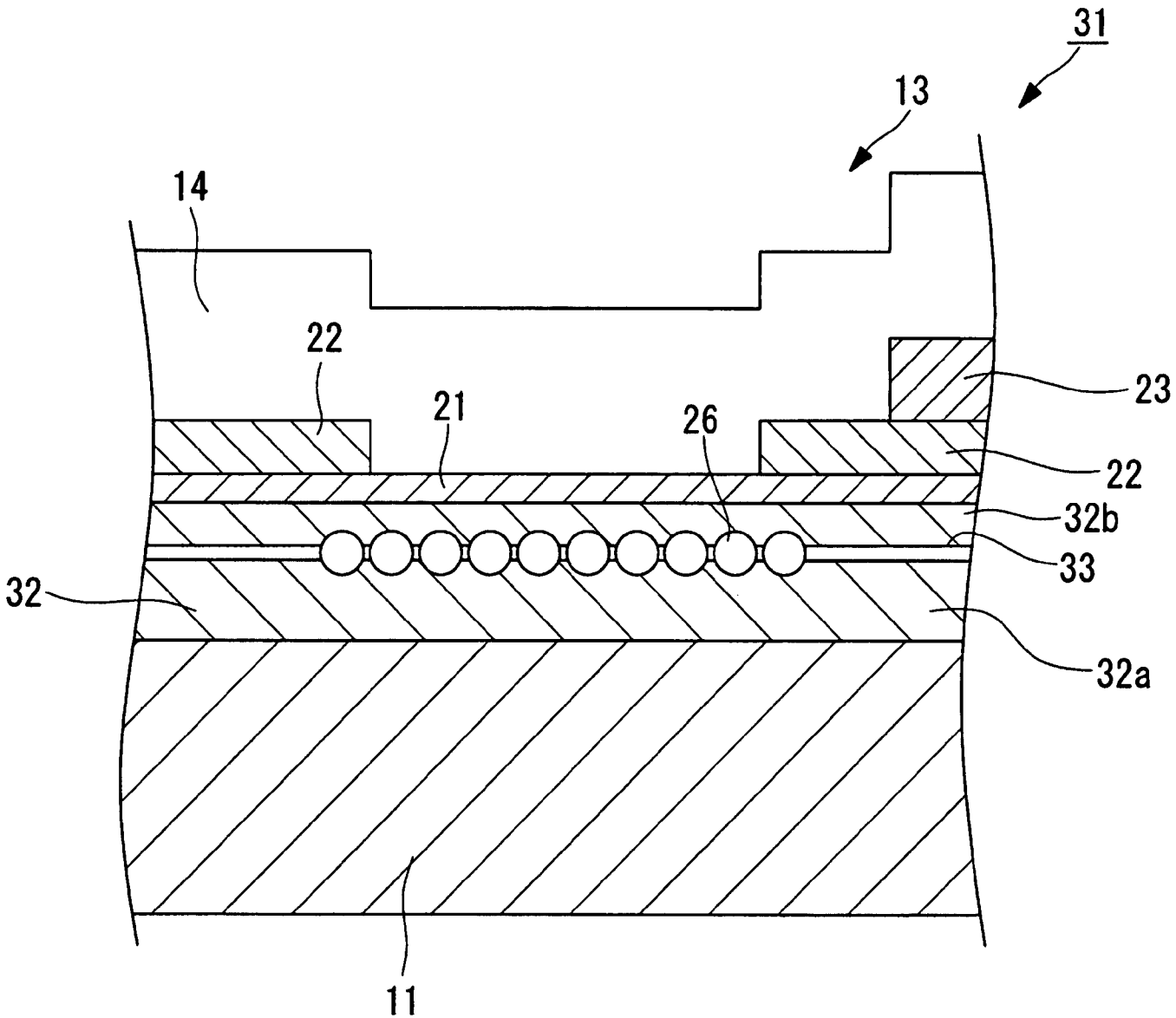
FIG. 7 is a longitudinal sectional view illustrating a structure of a thermal head according to a second embodiment of the present invention.

A second embodiment of the present invention is described in the following with reference to FIG. 7.

A thermal printer illustrated in this embodiment uses a thermal head 31 instead of the thermal head 4 in the thermal printer 1 illustrated in the first embodiment.

In the following, as to the similar or identical members to the thermal head 4 illustrated in the first embodiment, the same symbols are used to designate the members and detailed description thereof is omitted.

The thermal head 31 is provided with a thermal storage layer 32 instead of the thermal storage layer 12 in the thermal head 4.

The thermal storage layer 32 is provided with a reflection layer 33 provided at a position spaced apart from the surface of the thermal storage layer 12 where the heating resistors 13 are formed along the surface.

Here, the reflection layer 33 may be formed by a metal layer, an organic layer, a colored glass layer, or the like.

The thermal storage layer 32 can be easily prepared by, in a process of preparation by a lamination method, forming, at some midpoint in a lamination process, the reflection layer 33 on a glass layer 32*a* laminated, and by further forming a glass layer 32*b* on the reflection layer 33.

For example, the reflection layer 33 may be formed by a lamination method on the glass layer 32*a* laminated, or maybe formed by bonding a reflective material onto the glass layer 32*a* laminated. Further, the surface of the glass layer 32*a* laminated may be colored and the colored portion may form the reflection layer 33.

In the thermal head 31 structured as described above, because the thermal storage layer 32 has the reflection layer 33 at a position spaced apart from its surface along the surface, the shape of the surface of the thermal storage layer 32 can be estimated based on the shape of the surface of the reflection layer 33.

Therefore, by laser processing using the femtosecond laser with the reflection layer 33 being a mark for a process position, the hollow portions 26 can be formed along the surface of the thermal storage layer 32.

Therefore, in the thermal head 31, even if it is difficult to completely planarize the surface of the thermal storage layer 32 formed on the substrate 11 in a case, for example, where the substrate 11 is made of ceramic, the distance from the surface to the hollow portions 26 in the respective portions of the thermal storage layer 32 can be made constant.

By making constant the distance from the surface to the hollow portions 26 in the respective portions of the thermal storage layer 32, the strength and thermal insulation performance of the respective portions of the thermal storage layer 32 can be kept at a constant level, and thus, the quality is made stable.

In forming the hollow portions 26, a laser processing machine may set its focal point on the reflection layer 33, or alternatively, may detect the position of the reflection layer 33 and may form the hollow portions 26 above the position. In FIG. 7, a case is illustrated where the focal point of the laser processing machine is set on the reflection layer 33 to form the hollow portions 26.

Third Embodiment

Figure 8:
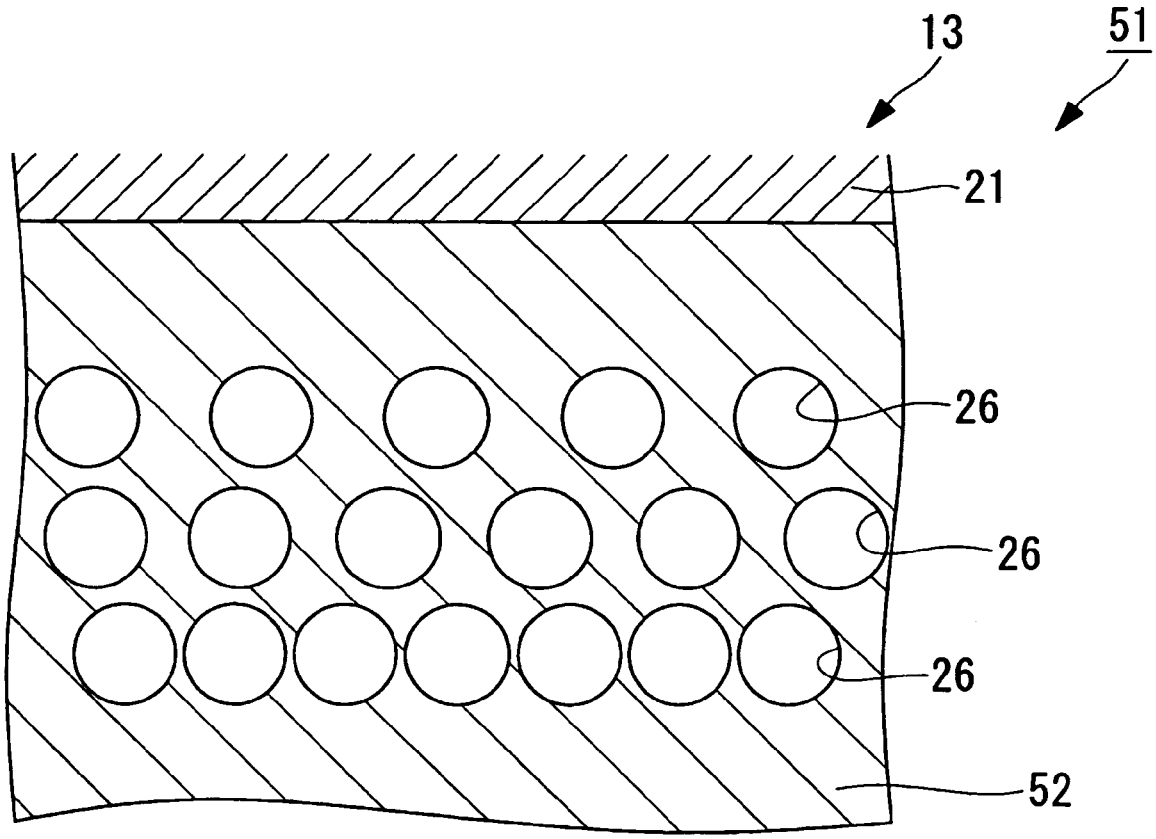
FIG. 8 is a longitudinal sectional view illustrating a structure of a thermal head according to a third embodiment of the present invention.

A third embodiment of the present invention is described in the following with reference to FIG. 8.

A thermal printer illustrated in this embodiment uses a thermal head 51 instead of the thermal head 4 in the thermal printer 1 illustrated in the first embodiment.

In the following, as to the similar or identical members to the thermal head 4 illustrated in the first embodiment, the same numerals are used to designate the members and detailed description thereof is omitted.

The thermal head 51 is provided with a thermal storage layer 52 instead of the thermal storage layer 12 in the thermal head 4.

In the thermal storage layer 52, the hollow portions 26 are distributed also in a thickness direction of the thermal storage layer 12. More specifically, the density of the hollow portions 26 in the thermal storage layer 52 decreases as the hollow portions 26 approaches the surface where the heating resistors 13 are formed. In FIG. 8, an example is illustrated where three sets of the hollow portions 26 are arranged along the surface of the thermal storage layer 52. The three sets are different in density from one another and are provided along the thickness direction of the thermal storage layer 52.

In the thermal storage layer 52, when the hollow portions 26 are formed by laser processing, the laser processing areas in the thermal storage layer 52 are shifted in the thickness direction of the thermal storage layer 52, and longer intervals are secured between the laser processing areas along the surface of the thermal storage layer 52 as the laser processing areas approach the surface of the thermal storage layer 52 where the heating resistors are formed.

In the thermal head 51 structured as described above, because the density of the thermal storage layer 52 increases as the distance from the substrate 11 for supporting the thermal storage layer 52 increases, the strength of the thermal storage layer 52 can be secured while the thermal head 51 has the structure in which the thermal storage layer 52 has the hollow portions 26 formed therein.

Therefore, a thermal printer using the thermal head 51 is excellent in durability.

Fourth Embodiment

A fourth embodiment of the present invention is described in the following with reference to FIG. 9.

A thermal printer illustrated in this embodiment uses a thermal head 61 instead of the thermal head 4 in the thermal printer 1 illustrated in the first embodiment.

In the following, as to the similar or identical members to the thermal head 4 illustrated in the first embodiment, the same symbols are used to designate the members and detailed description thereof is omitted.

The thermal head 61 is provided with a thermal storage layer 62 instead of the thermal storage layer 12 in the thermal head 4.

In the thermal storage layer 62, the hollow portions 26 are distributed also in a thickness direction of the thermal storage layer 12. More specifically, the hollow portions 26 are formed in the thermal storage layer 62 by laser processing using a femtosecond laser. The output of the femtosecond laser is set to be lower for the hollow portions 26 closer to the surface where the heating resistors 13 are formed.

The higher-powered the femtosecond laser used for the laser processing of the thermal storage layer 62 becomes, the larger the hollow portions 26 formed in the thermal storage layer 62 become, while the lower-powered the femtosecond laser becomes, the smaller the hollow portions 26 formed therein become.

Therefore, as described above, by making lower-powered the femtosecond laser used for the laser processing on the thermal storage layer 62 as the distance from the surface of the thermal storage layer 62 where the heating resistors 13 are formed decreases, the hollow portions 26 formed in the thermal storage layer 62 becomes smaller as the hollow portions 26 approach the surface where the heating resistors 13 are formed.

Figure 9:
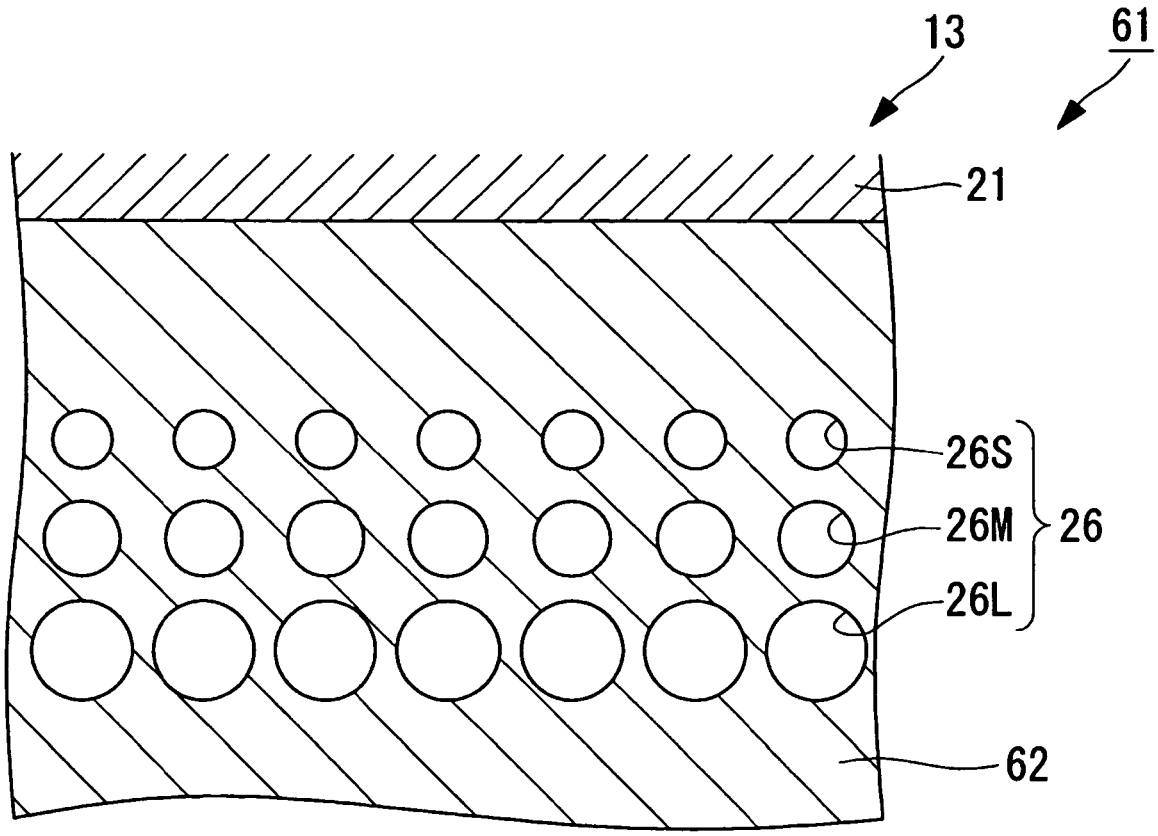
FIG. 9 is a longitudinal sectional view illustrating a structure of a thermal head according to a fourth embodiment of the present invention.

In FIG. 9, an example is illustrated where three sets of the hollow portions 26 are arranged along the surface of the thermal storage layer 62. The sizes of the hollow portions 26 of the three sets are different from one another and the three sets are provided along the thickness direction of the thermal storage layer 62. In FIG. 9, among the hollow portions 26 forming the sets of the hollow portions 26, hollow portions forming a set positioned nearest to the substrate 11 are denoted as hollow portions 26L, hollow portions forming a set positioned nearest to the heating resistors 13 are denoted as hollow portions 26S, and hollow portions forming a set positioned between these sets are denoted as hollow portions 26M. It is to be noted that, although, in the example illustrated in FIG. 9, the intervals between the hollow portions 26 (the intervals between centers of the hollow portions 26) in the respective sets of the hollow portions 26 is constant, the present invention is not limited thereto, and the intervals between the hollow portions 26 can be arbitrary.

In the thermal head 61 structured as described above, because the density of the thermal storage layer 62 increases as the distance from the substrate 11 for supporting the thermal storage layer 62 increases, the strength can be secured while the thermal head 61 has the structure in which the thermal storage layer 62 has the hollow portions formed therein.

Therefore, a thermal printer using the thermal head 61 is excellent in durability.

Fifth Embodiment

Figure 10:
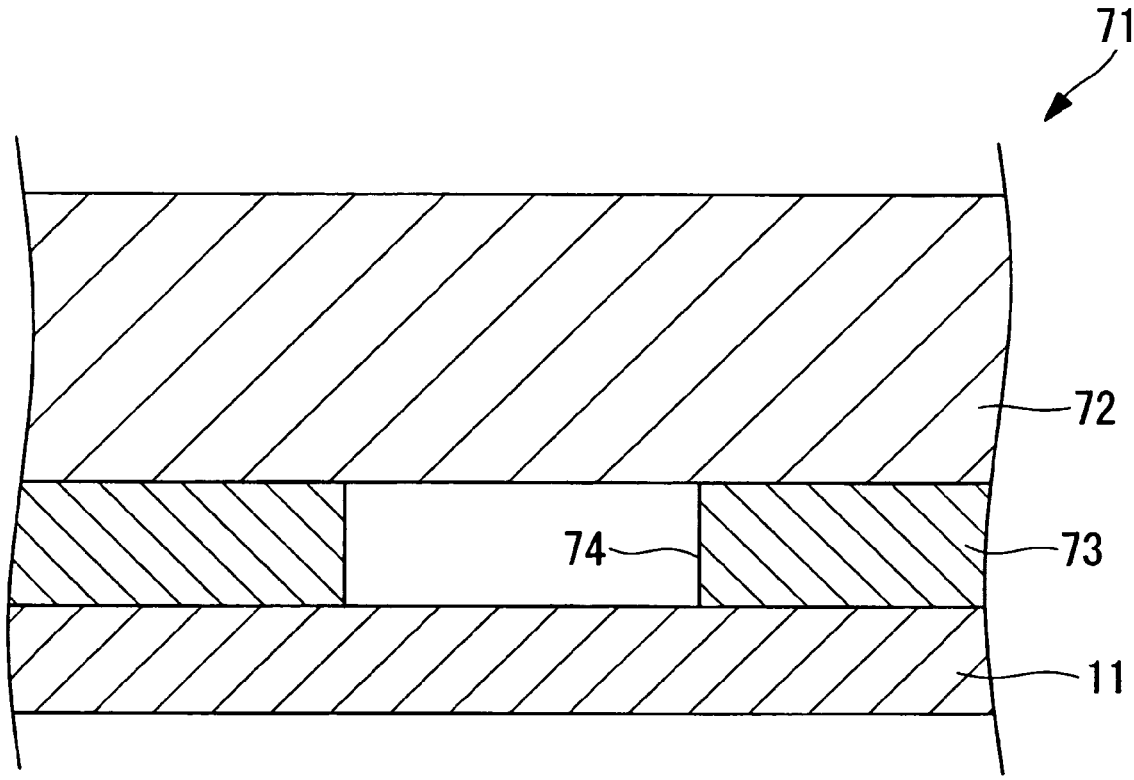
FIG. 10 is a longitudinal sectional view illustrating a manufacturing process of a thermal head according to a fifth embodiment of the present invention.
Figure 11:
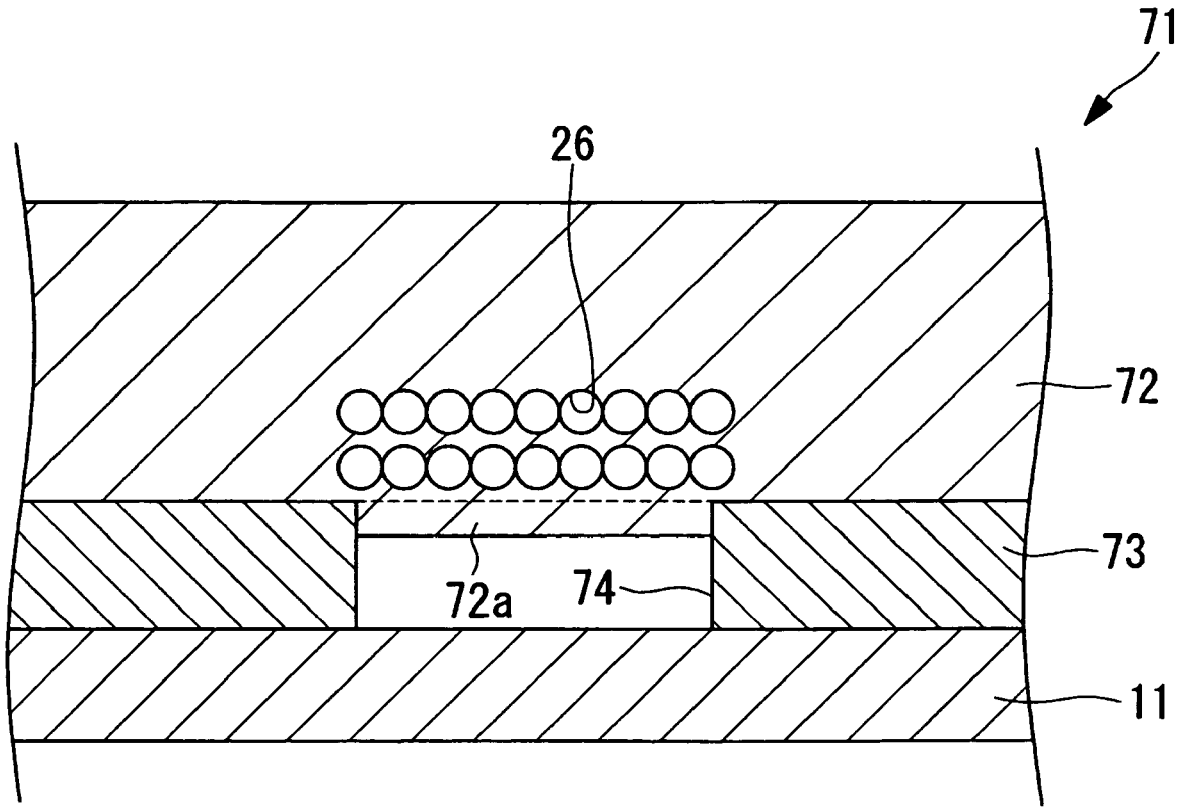
FIG. 11 is a longitudinal sectional view illustrating a structure of the thermal head according to the fifth embodiment of the present invention.

A fifth embodiment of the present invention is described in the following with reference to FIG. 10 and FIG. 11. Here, FIG. 10 is a longitudinal sectional view illustrating a manufacturing process of a thermal head 71 according to this embodiment, while FIG. 11 is a longitudinal sectional view illustrating a structure of a finished product of the thermal head 71 according to this embodiment.

A thermal printer illustrated in this embodiment uses the thermal head 71 instead of the thermal head 4 in the thermal printer 1 illustrated in the first embodiment.

In the following, as to the similar or identical members to the thermal head 4 illustrated in the first embodiment, the same symbols are used to designate the members and detailed description thereof is omitted.

The thermal head 71 is provided with a thermal storage layer 72 instead of the thermal storage layer 12 in the thermal head 4. The thermal storage layer 72 is not formed by a lamination method on the substrate 11, but is formed by a glass plate bonded to the substrate 11 via an adhesive layer 73. In other words, in the thermal head 71, the substrate 11 and the thermal storage layer 72 are bonded together by the adhesive layer 73 provided therebetween.

The adhesive layer 73 has a concave portion or an opening formed therein in an area which is opposed to an area of the thermal storage layer 72 where the heating resistors 13 are formed. In this embodiment, an opening 74 which extends to the substrate 11 is formed in the adhesive layer 73 in the area which is opposed to the area of the thermal storage layer 72 where the heating resistors 13 are formed.

Further, the thermal storage layer 72 has the hollow portions 26 formed therein as illustrated in FIG. 11 by laser processing after the thermal storage layer 72 is bonded to the substrate 11 as illustrated in FIG. 10.

In the thermal head 71 structured as described above, as described above, an opening 74 in the adhesive layer 73 is positioned at the side of the substrate 11 in the area in the thermal storage layer 72 where the laser processing is to be conducted.

Therefore, when the hollow portions 26 are formed by the laser processing in the thermal storage layer 72 made of glass, because glass 72*a* in the periphery of the laser processing area can escape into the opening 74 of the adhesive layer 73, the hollow portions 26 are formed without fail and the yield is improved.

Therefore, a thermal printer using the thermal head 71 can lower the manufacturing cost.

Here, in this embodiment, although an example is illustrated where the hollow portions 26 are formed with the reflection layer 33 provided in the thermal storage layer 32 serving as a mark, the present invention is not limited thereto, and, for example, the hollow portions 26 may be formed with a boundary between the substrate 11 and the thermal storage layer 12 serving as a mark.

It is to be noted that, although, in the above respective embodiments, examples where the heating resistor layer 21, the individual electrodes 22, and the common electrode 23 of the thermal head are prepared by a thin film process are illustrated, the present invention is not limited thereto, and the heating resistor layer 21, the individual electrodes 22, and the common electrode 23 may be prepared by a thick film process using gold resinate, ruthenium oxide, or the like.

Figure 12:
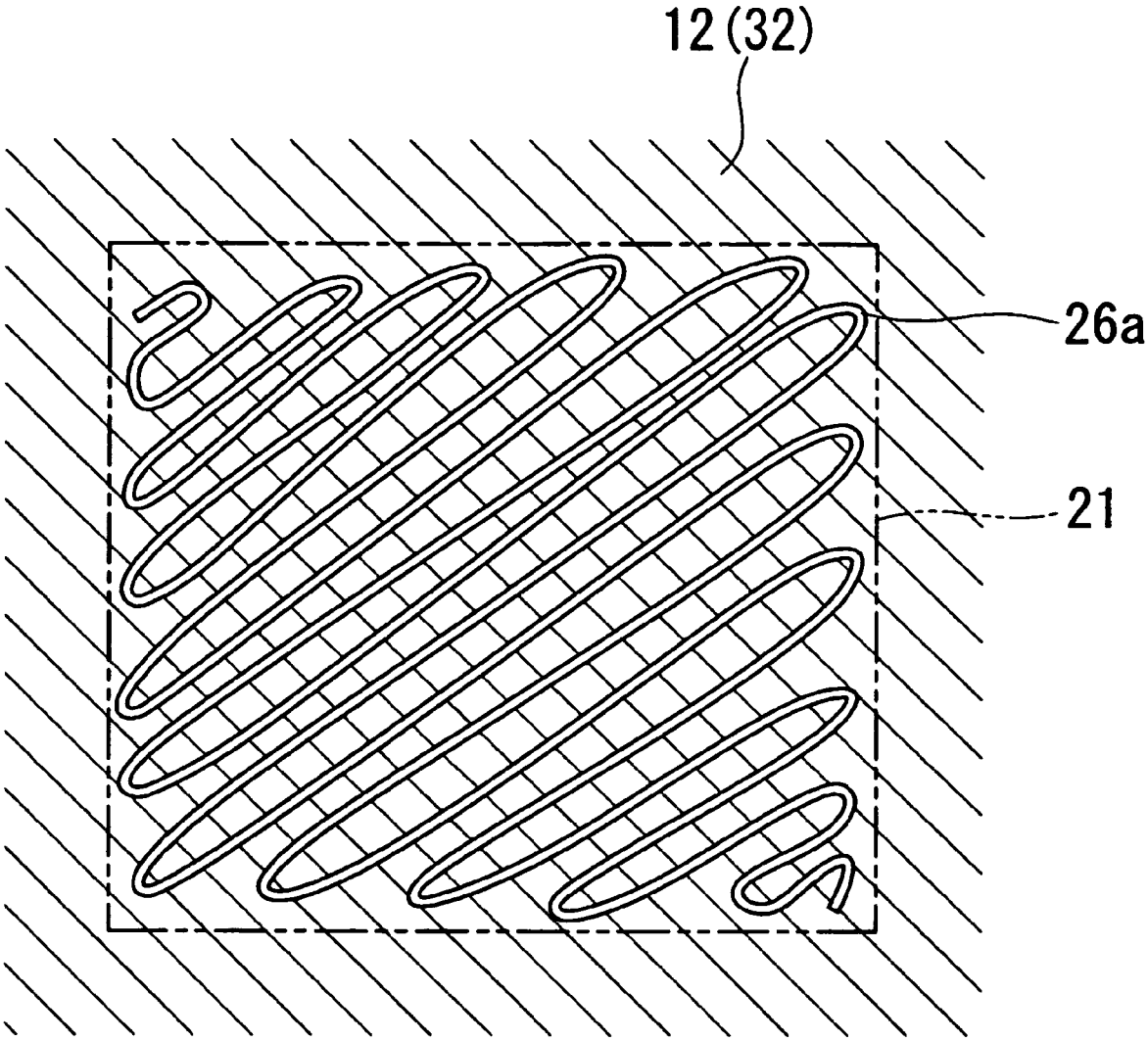
FIG. 12 is a sectional plan view illustrating another example of the thermal head according to the present invention.

Further, although, in the above respective embodiments, examples where the plurality of hollow portions 26 are provided in the area of the thermal storage layer 12 (or the thermal storage layer 32) which is opposed to the heating resistor layer 21 of the heating resistors 13 are illustrated, the present invention is not limited thereto, and, for example, as illustrated in FIG. 12, a serpentine hollow portion 26*a* may be formed at a position spaced apart from a surface where the heating resistors 13 are formed by laser processing using a femtosecond laser, in an area of the thermal storage layer 12 (or the thermal storage layer 32) which is opposed to the heating resistor layer 21 of the heating resistors 13.

In this case, also, the hollow portion 26*a* functions as a heat insulating layer for controlling the inflow of heat from the heating resistors 13 to the substrate 11. Further, because portions in the thermal storage layer 12 (or the thermal storage layer 32) which are left between portions of the serpentine hollow portion 26*a* (i.e., areas sandwiched between portions of the hollow portion 26*a*) function as supports for supporting upper and lower portions of the hollow portion 26*a* in the thermal storage layer 12 (or the thermal storage layer 32), the strength of the thermal storage layer 12 (or the thermal storage layer 32) is sufficiently secured even in the vicinity of the hollow portion 26*a*.

It is to be noted that the serpentine shape in this case includes a regularly bending geometric shape which extends transversely and longitudinally.

Further, the present invention can be applied to all forms of thermal heads irrespective of the structures such as a full glaze type, a partial glaze type, a near edge type, and the like.

Further, the present invention can be applied to all forms of thermal printers such as one referred to as a direct thermal type printer using a thermal paper, one using a thermal transfer ribbon such as a fusing type or a sublimation type, or more recently, one for re-transferring a printed image on a rigid medium after an image is once printed on a film-like medium.

Further, the present invention can be applied to, other than the thermal heads 4 and 31 illustrated in the above respective embodiments, electronic components having other film-like heating resistance elements such as a thermal erasing head having a structure substantially the same as that of the thermal heads 4 and 31, a fixing heater for a printer or the like which requires thermal fixing, and a thin film heating resistance element of a optical waveguide type optical component. Further, the present invention can also be applied to thermal ink-jet heads and bubble ink-jet heads.

What is claimed is:

1. A heating resistance element, comprising:

a substrate;

a thermal storage layer made of glass and formed on a surface of the substrate; and heating resistors provided on the thermal storage layer, wherein one of a plurality of hollow portions and a serpentine hollow portion is/are formed at a position spaced apart from a surface where the heating resistors are formed by laser processing using a femtosecond laser, in an area of the thermal storage layer which is opposed to the heating resistors.

2. The heating resistance element according to claim 1, wherein a distance from the surface of the thermal storage layer where the heating resistors are formed to the hollow portion is set to be in a range of 1 μm or more to 30 μm or less.

3. The heating resistance element according to claim 1, wherein the thermal storage layer is provided with a reflection layer at a position spaced apart from the surface where the heating resistors are formed along the surface.

4. The heating resistance element according to claim 1, wherein a dimension of the hollow portion in a thickness direction of the thermal storage layer is larger than the dimension of the hollow portion in a direction along the surface of the thermal storage layer.

5. The heating resistance element according to claim 1, wherein the substrate and the thermal storage layer are bonded together by an adhesive layer provided between the substrate and the thermal storage layer, wherein the adhesive layer has a concave portion or an opening formed in a portion of the thermal storage layer which is opposed to an area where the heating resistors are formed, and wherein the thermal storage layer has the hollow portion formed by the laser processing after the thermal storage layer is bonded to the substrate.

6. A thermal head, comprising the heating resistance element according to claim 1.

7. A printer using the thermal head according to claim 6.

8. A heating resistance element, comprising:

a substrate;

a thermal storage layer provided on the substrate; and heating resistors provided on the thermal storage layer, wherein an area of the thermal storage layer which is opposed to the heating resistors has a hollow portion, and wherein a specific gravity of a portion of the thermal storage layer in proximity to the hollow portion is set to be larger than that of other portions of the thermal storage layer.

9. The heating resistance element according to claim 8, wherein the portion of the thermal storage layer in proximity to the hollow portion is harder than the other portions of the thermal storage layer.

10. The heating resistance element according to claim 8, wherein a portion of a surface of the thermal storage layer opposed to the hollow portion is formed to be convex.

11. The heating resistance element according to claim 8, wherein the hollow portion is formed by laser processing.

12. The heating resistance element according to claim 8, wherein the hollow portion is formed by the laser processing using a femtosecond laser.

13. The heating resistance element according to claim 8, wherein a density of the hollow portion in the thermal storage layer decreases as the hollow portion approaches the surface where the heating resistors are formed.

14. The heating resistance element according to claim 8, wherein the hollow portion is formed in the thermal storage layer by the laser processing using the femtosecond laser, an output of the femtosecond laser becoming lower as the distance from the surface, where the heating resistors are formed, decreases.

15. A method of manufacturing a heating resistance element comprising a substrate, a thermal storage layer made of glass and formed on the substrate, and heating resistors provided on the thermal storage layer, the method comprising forming a hollow portion in an area of the thermal storage layer which is opposed to the heating resistors, by laser processing using a femtosecond laser.

16. The method of manufacturing a heating resistance element according to claim 15, further comprising forming the hollow portion such that a density of the hollow portion in the thermal storage layer decreases as the hollow portion approaches a surface where the heating resistors are formed.

17. The method of manufacturing a heating resistance element according to claim 15, further comprising forming, during the laser processing, the hollow portion by using the femtosecond laser whose output becomes lower as a distance from the surface of the thermal storage layer where the heating resistors are formed decreases.

18. The method of manufacturing a heating resistance element according to claim 15, wherein the substrate and the thermal storage layer are bonded together by an adhesive layer provided between the substrate and the thermal storage layer, wherein the adhesive layer is structured to have a concave portion or an opening formed in a portion of the thermal storage layer which is opposed to an area where the heating resistors are formed, and wherein the hollow portion is formed in the thermal storage layer by the laser processing after the substrate and the thermal storage layer are bonded together.

19. The method of manufacturing a heating resistance element according to claim 15, further comprising:

forming the thermal storage layer such that a reflection layer is provided along the surface of the thermal storage layer at a position spaced apart from the surface where the heating resistors are formed; and forming the hollow portion in an area of the thermal storage layer which is opposed to the heating resistors, by the laser processing using the femtosecond laser, with the reflection layer serving as a mark for a process position.

20. A method of manufacturing a heating resistance element comprising a substrate, a thermal storage layer formed on the substrate, and heating resistors provided on the thermal storage layer, the method comprising forming a hollow portion in an area of the thermal storage layer which is opposed to the heating resistors, by laser processing.

21. The method of manufacturing a heating resistance element according to claim 20, further comprising conducting processing, by the laser processing, such that a portion of the thermal storage layer in proximity to the hollow portion has a specific gravity larger than that of other portions of the thermal storage layer.

22. The method of manufacturing a heating resistance element according to claim 20, further comprising conducting processing, by the laser processing, such that a portion of the thermal storage layer in proximity to the hollow portion is harder than other portions of the thermal storage layer.

23. The method of manufacturing a heating resistance element according to claim 20, further comprising forming a portion of a surface of the thermal storage layer which is opposed to the hollow portion to be convex, by the laser processing.

* * * * *